United States Patent [19]

Morris

[11] 4,239,302

[45] Dec. 16, 1980

[54] SIDEBEARERS

[75] Inventor: Robert S. Morris, Cheltenham, England

[73] Assignee: Gloucester Railway Carriage & Wagon Company Limited, England

[21] Appl. No.: 896,339

[22] Filed: Apr. 13, 1978

[30] Foreign Application Priority Data

Apr. 14, 1977 [GB] United Kingdom ..... 15468/77

[51] Int. Cl.[3] ..... H01H 1/50; B61F 3/00

[52] U.S. Cl. ..... 308/138; 105/199 CB

[58] Field of Search ..... 105/199 CB, 199 R, 199 C; 308/15, 245, 137, 138, 3 R; 220/338, 340, 341, 353, 354

[56] References Cited

U.S. PATENT DOCUMENTS

| | | | |
|---|---|---|---|
| 2,197,783 | 4/1940 | Barrows | 308/138 |
| 2,327,954 | 8/1943 | Barrows et al. | 105/199 CB |
| 2,926,973 | 3/1960 | Ellis | 105/199 CB |
| 3,712,691 | 1/1973 | Cope | 105/199 CB |
| 3,910,448 | 10/1975 | Evans et al. | 220/354 |
| 3,915,520 | 10/1975 | Hassenauer | 105/199 CB |
| 4,014,450 | 3/1977 | Girotti et al. | 220/354 |

FOREIGN PATENT DOCUMENTS

| | | | |
|---|---|---|---|
| 1166652 | 10/1969 | United Kingdom | 105/199 CB |

*Primary Examiner*—Robert G. Sheridan
*Assistant Examiner*—Lawrence E. Williams
*Attorney, Agent, or Firm*—Young & Thompson

[57] ABSTRACT

The invention provides a sidebearer for use between the bogie and the underframe of a railway bogie vehicle. The sidebearer comprises a housing formed of upper and lower housing elements between which act springs contained within the housing. Guide formations comprising two spaced parallel walls are provided on the lower housing element, the upper housing element including a cooperating guide wall which engages between the spaced parallel walls so as to guide relative movement between the housing elements under and against the action of the springs.

6 Claims, 2 Drawing Figures

SIDEBEARERS

This invention relates to sidebearers such as are used on railway bogie vehicles and act between the bogie and the vehicle underframe to restrict relative rotational movement between the underframe and the bogie and thus control "hunting" of the bogie. Two sidebearers are normally employed and they are symmetrically disposed, one on each side of the bogie centre pivot.

It is an object of the invention to provide an improved form of sidebearer which can be produced more readily to the required tolerances and which is less susceptible to wear than sidebearers at present in use.

According to the invention, we provide a sidebearer which comprises first and second housing elements which cooperate to form a housing within which spring means are disposed, the first housing element being connected, in use, to the bogie and the second housing element carrying a friction pad which, in use, is biassed into engagement with a rubbing plate attached to the vehicle underframe, said first and second housing elements being provided with interengaging guide formations ensuring guided relative movement of the elements under and against the action of the spring means, which guide formations include two parallel spaced walls at one end of one of the housing elements and a wall at the corresponding end of the other housing element which fits between said two parallel spaced walls as a close sliding fit.

Said two parallel spaced walls preferably extend to positions adjacent the friction pad whereby the positions of engagement between the walls are located in close proximity to the line of action of the drag forces applied, in use, to the friction pad and acting longitudinally of the vehicle, i.e. at right angles to the direction of the spring means within the housing.

The first housing element, i.e. that which is connected to the bogie, may contain a packing element the thickness of which determines the initial state of compression of the spring means. It is thus possible to provide a range of sidebearers for use under differing load conditions using precisely the same springs but enabling different spring ratings to be obtained by appropriate selection of the thickness of the packing element.

The invention will now be described by way of example with reference to one embodiment of sidebearer which is illustrated in the accompanying drawings in which.

Figure 1:
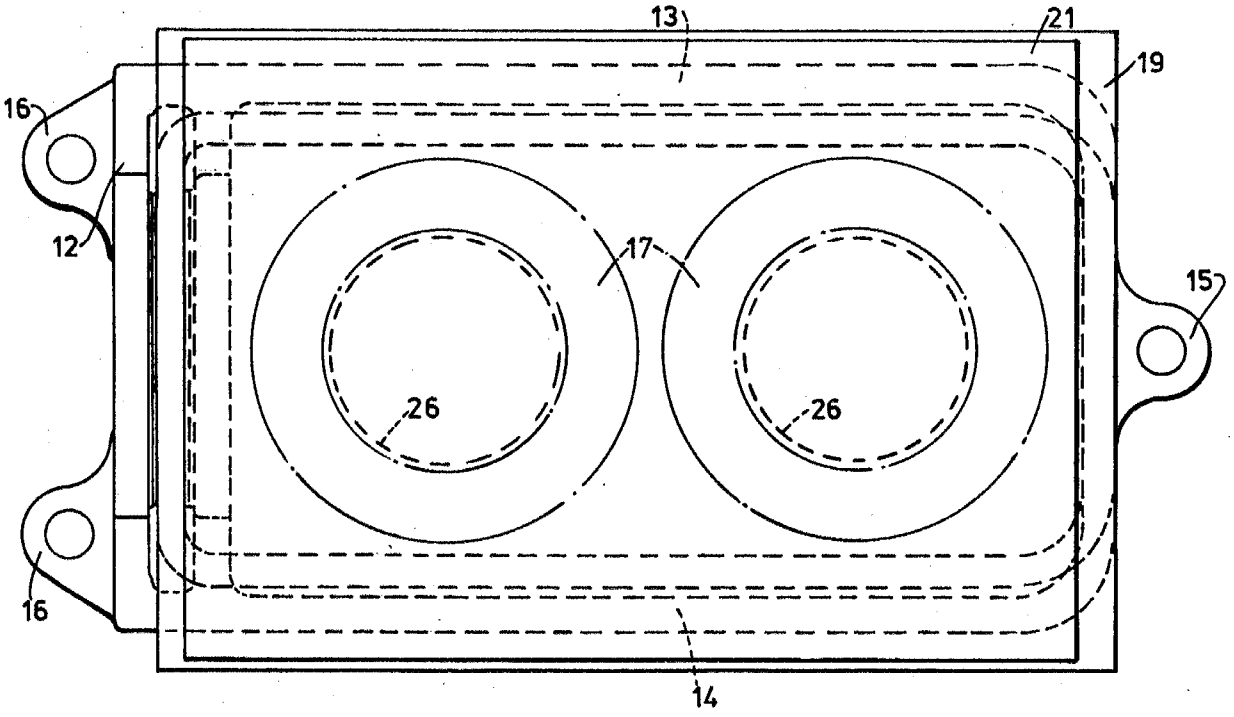
FIG. 1 is a plan view of the sidebearer.
Figure 2:
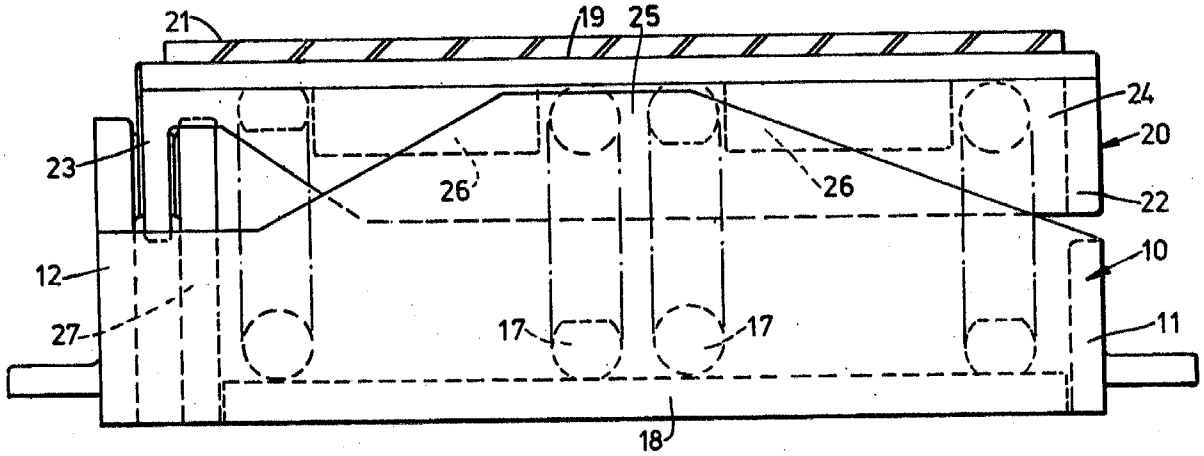
FIG. 2 is a side view of the sidebearer.

The sidebearer includes a lower housing element 10 which is connected, in use, to the transverse frame member of the bogie, two such sidebearers being incorporated in a bogie vehicle and located symmetrically one on each side of the bogie centre pivot. The lower housing element 10 is formed of malleable cast iron and is of rectangular form in plan view, having end walls 11 and 12, side walls 13 and 14 and an open base. A single apertured fixing lug 15 projects from end wall 11 whereas two apertured fixing lugs 16 project from end wall 12, the three lugs together providing stable three-point attachment of the sidebearer to the bogie.

Two helical springs 17 are contained within the lower housing element 10 and act between an optional packing element 18 disposed in engagement with the bogie and the lower surface of the top plate 19 of the upper housing element 20 of the side bearer. Said top plate 19 carries a friction pad 21 which is biassed by the springs 17 into frictional engagement with a rubbing plate (not shown) attached to the underside of the vehicle body. The upper housing element 20 is also formed of malleable cast iron and includes end walls 22 and 23 and side walls 24, the side walls 24 of the upper housing element 20 fitting between the side walls 13 and 14 of the lower housing element 10 whereby only limited relative transverse movement between the housing elements is permitted. There is, however, clearance between the side walls of the two housing elements so that precise machining of the wall surfaces is not required.

Each of the side walls 13 and 14 of the lower housing element includes a central portion 25 which extends to a position adjacent the top plate 19, which top plate overlaps the side walls 13 and 14, whereby the upper surfaces of said central portions 25 serve as stop surfaces to determine the degree of compression of the springs 17, the springs 17 being prevented from lateral displacement by the provision of spring guides 26 of circular form in plan view disposed beneath the top plate 19 and entering the upper ends of the springs 17. End wall 22 of the upper housing element 19 is spaced from the adjacent end wall 11 of the lower housing element 10 but end wall 23 is located between end wall 12 of the lower housing element 10 and an additional wall 27 disposed in parallel relationship to end wall 12. End wall 23 of the upper housing element 19 is provided with accurately machined wear-resistant surfaces as are the opposing faces of the walls 12 and 27 of the lower housing element, said interengaging walls 12, 23 and 27 affording guidance between the two housing elements and resisting longitudinal movement resulting from turning moments applied to the bogie in the horizontal plane while the vehicle is in motion. Accurate machining of the housing elements as a whole is not required since it is only the surfaces of said walls 12, 23 and 27 that are in sliding contact. Such contact is obtained adjacent the line of action of any longitudinal drag forces applied to the friction pad so that relative rotation or tilting of the housing elements is kept to a minimum thus avoiding wear of the corner portions of the contacting surfaces of the walls 12, 23 and 27.

It should be noted that any pitching of the bogie frame relative to the vehicle body will cause similar pitching of the top plate 19 relative to the lower housing element 10. This relative pitching will involve tangential movements at the guide formations but, since these tangential movements are almost vertical, it is possible to allow a much smaller clearance between the opposed surfaces of the walls 12, 23 and 27 than would otherwise be the case. A closer sliding fit of wall 23 between walls 12 and 27 can thus be obtained.

I claim:

1. A sidebearer for a railway bogie vehicle, comprising first and second housing elements which cooperate to form a housing within which spring means are disposed, the first housing element being connected, in use, to the bogie and the second housing element carrying a friction pad which, in use, is biassed into engagement with a rubbing plate attached to the vehicle underframe, said first and second housing elements being provided with interengaging guide formations ensuring guided relative movement of the elements under and against the action of the spring means, which guide formations include two parallel spaced walls only at one end of one of the housing elements and a wall at the corresponding end of the other housing element which fits between said two parallel spaced walls as a close sliding fit, the two parallel walls being on said first housing element, the two parallel walls extending, in use, to positions adjacent the friction pad, whereby the positions of engagement between the walls are located in close proximity to the line of action of the drag forces applied, in use, to the friction pad.

2. A sidebearer according to claim 1, wherein two springs are provided which act, in use, between the bogie and a top plate of the second housing element.

3. A sidebearer according to claim 2, wherein a packing element is provided within the first housing element between the springs and the bogie.

4. A sidebearer according to claim 1, wherein the housing elements are of rectangular form in plan view and the second housing element has side walls disposed, with clearance, between side walls of the first housing element.

5. A sidebearer according to claim 4, wherein the side walls of the first housing element serve as stops to limit the degree of compression of the spring means.

6. A sidebearer for a railway bogie vehicle, comprising first and second housing elements which cooperate to form a housing within which spring means are disposed, the first housing element being connected, in use, to the bogie and the second housing element carrying a friction pad which, in use, is biassed into engagement with a rubbing plate attached to the vehicle underframe, said first and second housing elements being provided with interengaging guide formations ensuring guided relative movement of the elements under and against the action of the spring means, which guide formations include two parallel spaced walls only at one end of one of the housing elements and a wall at the corresponding end of the other housing element which fits between said two parallel spaced walls as a close sliding fit.

* * * * *